US008659432B2

(12) United States Patent
Alicea-Ibern et al.

(10) Patent No.: US 8,659,432 B2
(45) Date of Patent: Feb. 25, 2014

(54) SECURITY SYSTEM FOR AUTOMATICALLY DETECTING A PERSON OVERBOARD USING RFID

(75) Inventors: Rafael V. Alicea-Ibern, Guaynabo, PR (US); Steven Henriquez-Vargas, Carolina, PR (US)

(73) Assignee: US New Technology, LLC, San Juan, PR (US)

( * ) Notice: Subject to any disclaimer, the term of this patent is extended or adjusted under 35 U.S.C. 154(b) by 113 days.

(21) Appl. No.: 13/311,763

(22) Filed: Dec. 6, 2011

(65) Prior Publication Data

US 2013/0141234 A1 Jun. 6, 2013

(51) Int. Cl.
*G08B 23/00* (2006.01)
*G08B 13/14* (2006.01)

(52) U.S. Cl.
USPC ..... 340/573.1; 340/573.4; 340/573.6; 340/572.1; 340/539.11

(58) Field of Classification Search
USPC ..... 340/572.1, 573.1, 573.4, 573.6, 539.1, 340/539.11, 539.13, 539.26, 10.42, 572.8; 116/210, DIG. 9; 701/21
See application file for complete search history.

(56) References Cited

U.S. PATENT DOCUMENTS

| | | | | |
|---|---|---|---|---|
| 4,305,143 | A | 12/1981 | Simms | |
| 4,630,205 | A | 12/1986 | Otaka | |
| 5,021,765 | A | 6/1991 | Morgan | |
| 5,463,598 | A | 10/1995 | Holland | |
| 5,886,635 | A | 3/1999 | Landa | |
| 5,945,912 | A * | 8/1999 | Guldbrand | 340/573.1 |
| 6,057,759 | A | 5/2000 | Marsh | |
| 6,222,484 | B1 * | 4/2001 | Seiple et al. | 342/357.55 |
| 7,335,077 | B2 | 2/2008 | Chiappetta | |
| 2008/0297341 | A1 * | 12/2008 | McClanahan | 340/539.13 |
| 2009/0219160 | A1 | 9/2009 | Shervey | |

* cited by examiner

*Primary Examiner* — Anh V La
(74) *Attorney, Agent, or Firm* — Walter O. Alomer

(57) ABSTRACT

A security system for automatically detecting and signaling the event of a person falling overboard from a vessel into a body of water includes a radio frequency identification (RFID) tag worn by each passenger onboard a vessel, one or more RFID readers placed surrounding the hull of the vessel, a control unit onboard the vessel wherein the RFID readers are individually connected, and an alarm system. When a person who is wearing the RFID tag falls overboard, he or she would inevitably pass through one or more of the RFID readers placed surrounding the hull of the vessel. One or more RFID readers read the information contained in the RFID tag, and said information is transmitted from the RFID reader to the control unit. The control unit records the time and location of the event, and activates an alarm system for facilitating the rescue of the person.

5 Claims, 4 Drawing Sheets

SECURITY SYSTEM FOR AUTOMATICALLY DETECTING A PERSON OVERBOARD USING RFID

STATEMENT REGARDING FEDERALLY SPONSORED RESEARCH AND DEVELOPMENT

Not applicable

RELATED APPLICATIONS

Not applicable

BACKGROUND OF THE INVENTION

1. Field of the Invention

The present invention relates to a security system for monitoring persons aboard a vessel using radio frequency identification (RFID), and more particularly, to a security system for automatically detecting and signaling the event of a person falling overboard from a vessel into a body of water. Said security system also provides the exact time and location of the event for facilitating the rescue of said person.

2. Background

Traveling in a boat, cruise ship or other vessel is very popular but it can be risky. More often people on cruise ships disappear or fall overboard. In both instances, the event occurs without anyone noticing until it is too late. The likelihood of a successful rescue depends on the quickness of detecting said person overboard. Therefore, there is a need for an improved security system that can automatically detect and signal when a person falls overboard from a vessel, and that can determine the exact time and location of said event in order to rescue said person.

Various systems have been developed to detect a person overboard. Most of these systems rely upon the use of a transmitter attached to a person who has fallen overboard to send a signal (ultrasonic waves, radio waves, acoustic signal, or electromagnetic signal) through air or water to a receiver onboard the vessel when said transmitter is immersed in water. See U.S. Pat. Nos. 4,305,143; 5,463,598; 5,021,765; and 5,886,635. The success of these systems depends on producing a signal of sufficient strength that can travel through air or water to reach the receiver on the ship.

Other systems rely upon continuously monitoring a signal transmitted by a transmitter attached to each person onboard a vessel. When the transmission of the signal is terminated upon entry of the transmitter into water, an alarm is triggered. See U.S. Pat. Nos. 4,549,169; and 6,057,759. Systems that depend on the interruption of a signal are impractical for vessels with large numbers of people on board. This is due to the fact that: 1) each transmitter would have to be active at all times, thus requiring a large amount of power supply; and 2) the receiver would have to be monitoring each individual signal at all times, thus requiring an excessively complex receiver.

A common deficiency to all the systems explained above is that the transmitter, and eventually the man overboard alarm system, is triggered upon immersion of the transmitter in water. People on boats, cruise ships or other vessels like to swim in the pool or at the beach. In those circumstances, where no risk of a person overboard exists, the transmitter would be immersed in water and said receivers would recognize such immersion as a person overboard thus causing false alarms.

Another system that has been developed to detect a person overboard relies upon the use of several infrared (IR) sensors which are placed surrounding the hull of a vessel. The IR sensors produce light beams which are detected by another IR sensor. When a person falls overboard, he passes through the sensors breaking the light beam. The light beam interruption triggers an alarm. See U.S. Pat. No. 7,335,077. A deficiency of this system is that objects other than a person overboard (e.g., water or a bird) can pass through the IR sensor, breaking the light beam, and thus activating the alarm. False alarms will cause the crew to react more slowly in the event of a real emergency. Also multiple activations of the alarm system by accident would be very unpleasant for the passengers aboard the vessel.

Therefore, there is a need for a security system that can detect a person overboard more accurately, that does not depend upon immersion of the activation device in water, and that would not be triggered by accidental or false alarms.

SUMMARY OF THE INVENTION

The present invention avoids and overcomes these and other problems by providing an automatic detecting and signaling system which is activated when a person, who is wearing a radio frequency identification (RFID) tag, falls overboard from a vessel into a body of water; one or more RFID readers which are placed surrounding the hull of the vessel that can detect individually the passage of the RFID tag worn by the person falling overboard through said RFID readers; each RFID reader is connected to a control unit onboard the vessel; the RFID reader transmits to the control unit the information obtained from the RFID tag; the control unit records the exact time and location of the person overboard; and the control unit activates an alarm system for facilitating the rescue of said person.

An object of the present invention is to provide a security system that can automatically detect and signal when a person falls overboard from a vessel, which does not depend upon immersion of the activation device in water.

An object of the present invention is to provide a security system that can detect and signal a person overboard immediately; even before said person have entered the water.

Another object of the present invention is to provide a security system that can determine the exact time and location of the event of a person overboard for facilitating the rescue of said person.

Another object of the present invention is to provide a security system which is capable of operating only when needed and which safeguards from activation upon accidental handling.

Another object of the present invention is to provide a security system that can easily record every time when a person embarks or disembarks the vessel. In this way, the person in charge of the vessel can immediately and easily account for all passengers onboard.

Another object of the present invention is to provide a security system for identification of the passengers onboard a vessel. Such information includes but it is not limited to passenger's name, passenger's digital photograph, cabin number, dinner table, account number, credit card number, health problems and the number of persons that travel with him.

The invention itself, both as to its configuration and its mode of operation will be best understood, and additional objects and advantages thereof will become apparent, by the following detailed description of a preferred embodiment taken in conjunction with the accompanying drawings.

When the word "invention" is used in this specification, the word "invention" includes "inventions", that is, the plural of "invention". By stating "invention", the Applicant does not in any way admit that the present application does not include more the one patentable and non-obviously distinct invention and Applicant maintains that the present application may include more than one patentably and non-obviously distinct invention. The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The following drawings should be read with reference to the detailed description. Like numbers refer to like elements. The drawings, which are not necessarily to scale, illustratively depict embodiments of the present invention and are not intended to limit the scope of the invention.

DETAILED DESCRIPTION OF THE INVENTION

A security system for automatically detecting and signaling the event of a person falling overboard from a vessel into a body of water includes a radio frequency identification (RFID) tag worn by each passenger onboard a vessel, one or more RFID readers placed surrounding the hull of the vessel, a control unit onboard the vessel wherein the RFID readers are individually connected, and an alarm system. When a person who is wearing the RFID tag falls overboard, he or she would inevitably passes through one or more of the RFID readers placed surrounding the hull of the vessel. One or more RFID readers read the information contained in the RFID tag, and said information is transmitted from the RFID reader to the control unit. The control unit records the time and location of the event, and activates an alarm system for facilitating the rescue of the person.

Figure 1:
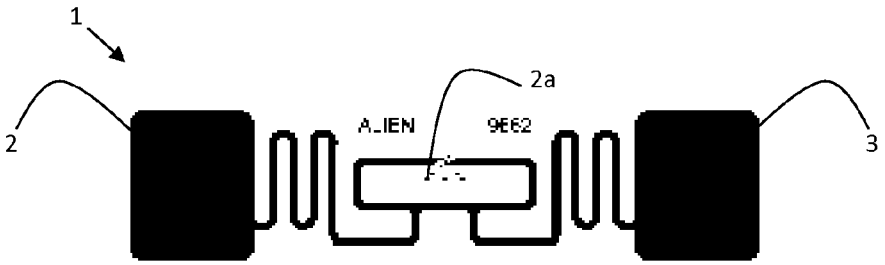
FIG. 1 shows a RFID tag.

FIG. 1 is directed to the RFID tag 1. The RFID tag 1 comprises a power source, a microprocessor or integrated circuit (IC) and an antenna, wherein the power source 2, the IC 2*a* and said antenna 3 are electrically connected by means of coils. The IC 2*a* is used to store information such as tag identifier or user's personal information. Examples of tag identifier are a code, a password or a series of number, wherein said tag identifier is further linked to the user's personal information, previously stored in a control unit computer database. Example of user's personal information are user's name, user's digital photograph, cabin number, dinner table, account number, credit card number, health problems, the number of persons that travel with him and/or any other information that helps identify or assist the user. Said information is written or stored in the RFID tag 1 using a RFID writer R1, which is explained in more details below.

Figure 2A:
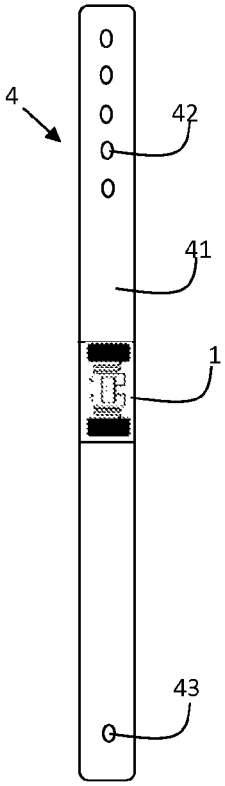
FIGS. 2A through 2C show exemplary embodiments for devices carrying the RFID tag in accordance with the principles of the present invention.
Figure 2B:
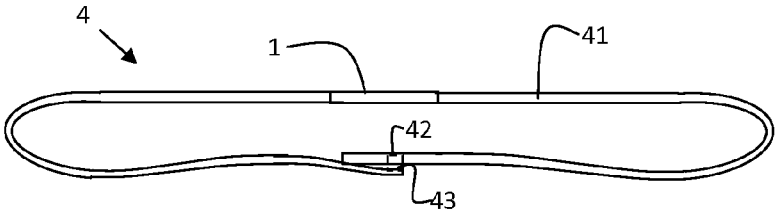
Figure 2C:
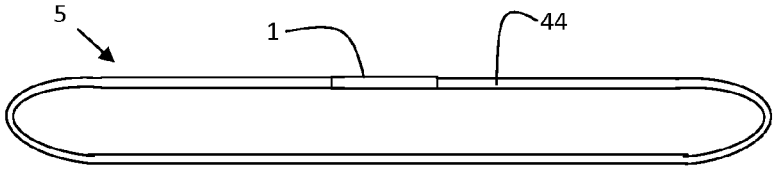

FIG. 2A through FIG. 2C is directed to a bracelet 4 and wristband 5 embedded with the RFID tag 1. The bracelet 4 and wristband 5 can be made of different flexible materials such as plastic, silicone or any other polymer which is water resistant. However the selected material provides protection to the RFID 1 from environmental hazards such as dust and more, while allowing the RFID tag 1 to receive a signal from a RFID reader 6. The RFID reader 6 is explained in more details below.

FIG. 2A show an open loop bracelet, wherein said bracelet 4 comprises a longitudinal body 41 with receiving means, such as holes 42, and attaching means, such as a protrusion 43, wherein said protrusion is inserted in at least one hole 42 as shown in FIG. 2B in order to fix loop circumference of the bracelet 4. The configuration is provided to be wear by user, such as passengers at a vessel. Further the RFID tag 1 may be embedded in a wristband 5 which comprises a close-loop longitudinal body 44, as shown in FIG. 2C.

Figure 3:
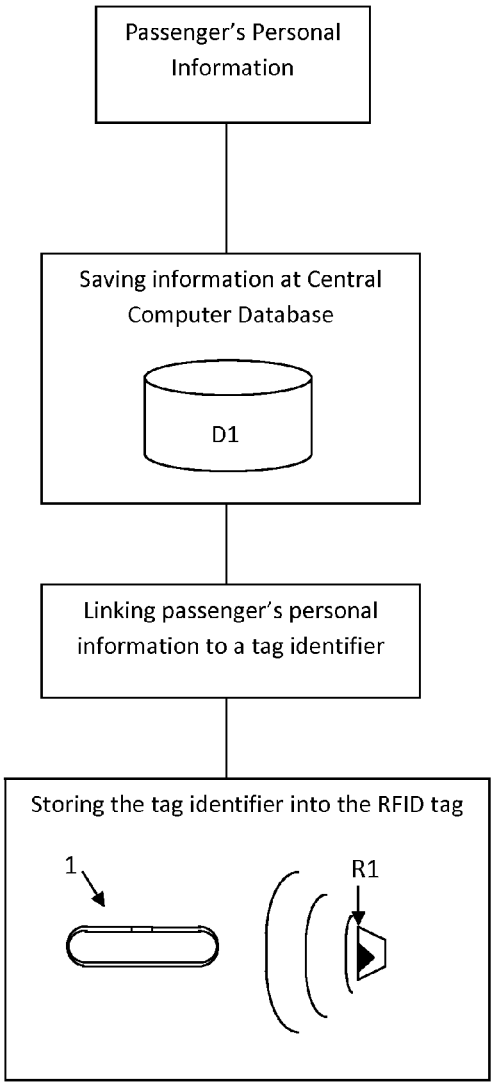
FIG. 3 shows exemplary flowchart of the process to store information into the database of the control unit while linking said information to a tag identifier and storing said tag identifier into the RFID tag in accordance with the principles of the present invention.

FIG. 3 shows a flowchart in accordance with the principle of the present invention wherein a passenger receives a RFID tag 1 in form of a bracelet 4 or wristband 5 before embarking the vessel. Before receiving said RFID tag 1, the passenger is required to provide personal information which is stored in a control unit computer database D1. The information stored on the database D1 is further linked to a tag identifier. Said tag identifier is then stored on the passenger's RFID tag 1 using a RFID writer R1.

The RFID writer R1 is connected to the control unit computer database D1 which uploads the information of the passenger. The RFID writer R1 may store the passenger's personal information into the RFID tag 1 or store only the tag identifier into the RFID tag 1 in order to link the passenger's personal information to the tag identifier. One advantage of using the tag identifier instead of the passenger's personal information in the RFID tag 1 is the protection of said personal information in case where the RFID tag 1 is lost or stolen.

Figure 4:
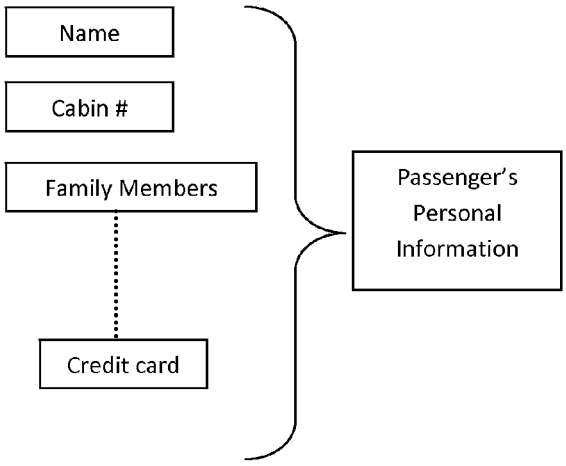
FIG. 4 shows exemplary fields of passenger's personal information to be stored at the database further linked to the RFID tag identifier in accordance with the principles of the present invention.

As shown in FIG. 4, the passenger provides personal information which includes but is not limited to the passenger's name, passenger's digital photograph, cabin number, dinner table, account number, credit card number, health problems, number of persons that travel with him or her and any other information that helps identify or assist the passenger. Further, inside the vessel, the passenger can use their RFID tag 1 to make purchases in a shop inside the vessel. The word shop includes but is not limited to gift shops, bars, and restaurants, wherein said shops are equipped with RFID readers 6 that can read the information in the RFID tag 1 as part of a purchase. All purchases and transactions are then recorded in the control unit computer database D1.

To avoid multiple signals aboard the vessel, it is recommended that the RFID tag 1 be passive. When a passive RFID tag 1 is to be read, an REID reader 6 sends it a radio signal. The RFID tag 1 absorbs some of the energy from the RFID reader 6 and reflects it back as a return signal delivering the information stored in the IC 2*a* of the RFID tag 1. The information received by the RFID reader 6 is transmitted to the control unit, wherein the RFID reader 6 is connected, for processing. The RFID reader 6 can read the information stored in the RFID tag 1 without contact or line of sight with the RFID tag 1. Furthermore, said information can be read through the human body, clothing and non-metallic materials.

Figure 5:
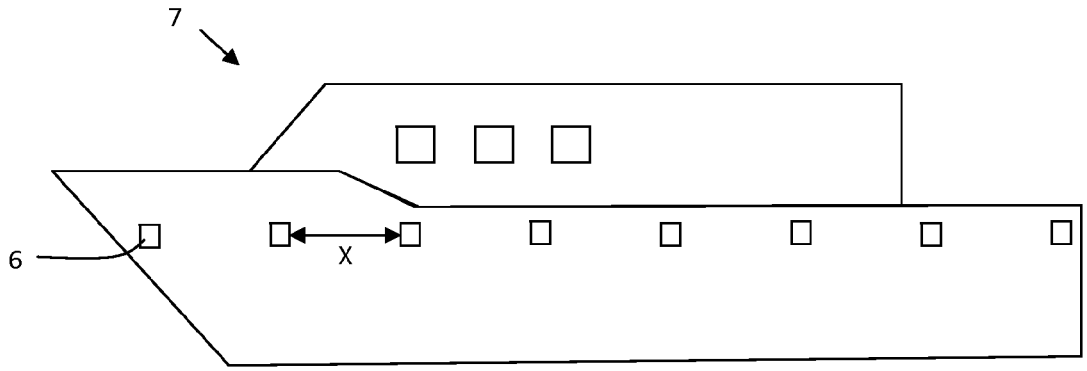
FIG. 5 shows an exemplary embodiment for a vessel equipped with one or more RFID readers in accordance with the principles of the present invention.
Figure 6:
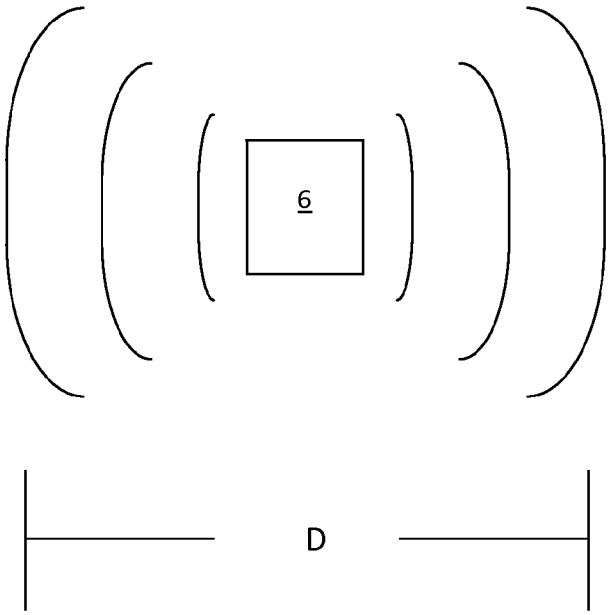
FIG. 6 shows an exemplary embodiment for the RFID reader in accordance with the principles of the present invention.

FIG. 5 is a representation of a vessel 7 in which the apparatus and methods in accordance with the principles of the present invention may be practiced. The vessel 7 includes a hull and a deck. One or more RFID readers 6 are placed surrounding the hull of the vessel 7 with a particular distance of separation X between them. Said distance of separation X depends upon the scanning area D of the RFID readers 6, as shown in FIG. 6. The scanning area of the RFID reader 6 is define as the area wherein the signal from the RFID reader 6 will interact with RFID tag 1 causing the RFID tag 1 to deliver to the RFID reader the information contained in it. Preferably the particular separation distance X is equal to or less than the scanning area D of the RFID readers 6. In this way, the possibilities of any blind spot are reduced.

Each RFID reader 6 is connected to a control unit onboard the vessel 7, where it sends all the information each RFID reader 6 receives. Each RFID reader 6 is placed in a specific location around the hull of the vessel. Furthermore, the control unit identifies each RFID reader 6 individually, and therefore, recognizes the particular RFID reader 6 that sends information.

Figure 7:
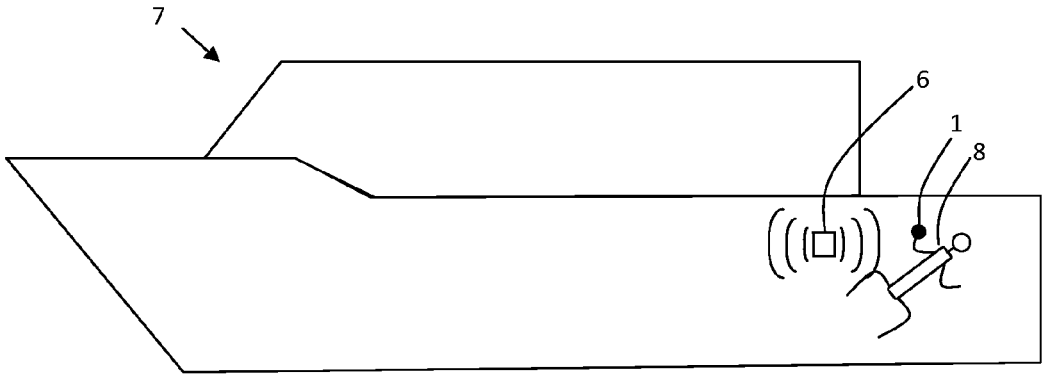
FIG. 7 shows an exemplary embodiment for the RFID reader reading information from the RFID tag worn by a person falling from the vessel in accordance with the principles of the present invention.
Figure 8:
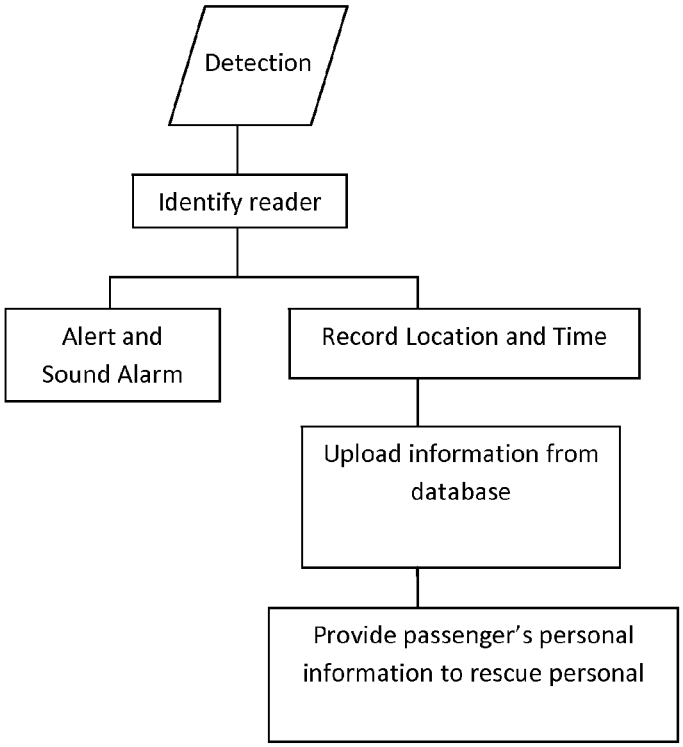
FIG. 8 shows an exemplary flow chart for the detection process in accordance with the principles of the present invention.

As shown in FIG. 7, when a passenger 8, who is wearing the RFID tag 1, falls overboard, he or she would inevitably pass through one or more of the RFID readers 6 outside the vessel 7. Said RFID reader 6 will receive the information stored on the RFID tag 1, and will send said information to the control unit. The control unit records the exact time of the event when the information is received. Also, the control unit recognizes the particular RFID reader 6 which sent said information, and thus, the control unit records the exact location of the event. In this way, the security system of the present invention determines the exact time and exact location of a person overboard. As shown in FIG. 8, the control unit also activates an alarm system for facilitating the rescue of the passenger 8.

In a second embodiment of the present invention, RFID readers 6 are placed at the exit and at the entrance of the vessel 7 as part of a disembark notification system. Every time a passenger 8 disembarks the vessel, he must pass his RFID tag 1 through the RFID reader 6. The RFID reader 6 sends the information to the control unit indicating that said person has disembarked the vessel 7. When the person returns to the vessel 7, said person must pass his RFID tag 4 through a RFID reader 6. The RFID reader 6 sends the information to the control unit indicating that said person has embarked the vessel 7. In this way, the security system provides an easy and reliable method to account for all passengers aboard the vessel 7.

In a third embodiment of the present invention, RFID readers 7 are placed on the locks of the cabins of the vessel 7. The passengers 8 can use their RFID tags 1 as part of an authentication system to open their cabins.

While the invention has been described as having a preferred design, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

What is claimed is:

1. A security system to detect a person falling overboard from a vessel comprising:

a) a radio frequency identification tag worn by a person onboard a vessel, wherein said radio frequency identification tag contains a first information;

b) a plurality of radio frequency identification readers, wherein each radio frequency identification reader includes a scanning area D, wherein said plurality of radio frequency identification readers are installed surrounding the hull of the vessel at a distance X from each other, wherein said distance X is less than the scanning area D, wherein said distance X permits at least a first radio frequency identification reader and a second radio frequency identification reader from the plurality of the radio frequency identification readers to detect said radio frequency identification tag in an event of said person falling overboard, wherein said first radio frequency identification reader detects said frequency identification tag passing through the first radio frequency identification reader scanning area D generating a first time and first location for said radio frequency identification tag and wherein said second radio frequency identification reader detects said radio frequency identification tag passing through the second radio frequency identification reader scanning area D generating a second time and second location for said radio frequency identification tag;

c) a control unit on board the vessel, wherein said first radio frequency identification reader and said second radio frequency identification reader are operatively connected to said control unit, wherein said control unit recognizes individually each radio frequency identification reader;

wherein the first radio frequency identification reader transmits to the control unit the first information received from the radio frequency identification tag, wherein the control unit further records the first time and first location;

wherein the second radio frequency identification reader transmits to the control unit the first information received from the radio frequency identification tag, wherein the control unit further records the second time and second location, and the control unit triggers an alarm.

2. The system of claim 1, wherein said control unit comprises a database, wherein personal information of the passenger is stored at said database, wherein the first information stored in the radio frequency identification tag is a tag identifier, wherein said tag identifier is linked to said passenger's personal information; and wherein the control unit provides the passenger's personal information in the event of said person falls overboard.

3. The system of claim 2, further comprising a disembark notification system.

4. The system of claim 2, further comprising radio frequency identification readers installed in a shop inside the vessel; the passenger can use his or her radio frequency identification tag to make purchases in said shop, and all transactions are stored in the control unit computer data base.

5. The system of claim 2, further comprising radio frequency identification readers installed on the locks of one or more cabins inside the vessel as part of an authentication system that can only be open using the passenger's radio frequency identification tag.

* * * * *

UNITED STATES PATENT AND TRADEMARK OFFICE

CERTIFICATE OF CORRECTION

PATENT NO. : 8,659,432 B2
APPLICATION NO. : 13/311763
DATED : February 25, 2014
INVENTOR(S) : Rafael V. Alicea-Ibern and Steven Henriquez-Vargas It is certified that error appears in the above-identified patent and that said Letters Patent is hereby corrected as shown below:

On the Title Page

Item (73) the name of the Assignee should read: VS New Technology, LLC.

Item (74) the name of the Attorney, Agent or Firm should read: Walter O. Alomar.

Signed and Sealed this
Twenty-fourth Day of March, 2015

Michelle K. Lee

Michelle K. Lee
*Director of the United States Patent and Trademark Office*